United States Patent [19]

Sadwick

[11] Patent Number: 5,017,964

[45] Date of Patent: May 21, 1991

[54] CORONA CHARGE SYSTEM AND APPARATUS FOR ELECTROPHOTOGRAPHIC PRINTING PRESS

[75] Inventor: Paul V. Sadwick, Dayton, Ohio

[73] Assignee: AM International, Inc., Chicago, Ill.

[21] Appl. No.: 442,880

[22] Filed: Nov. 29, 1989

[51] Int. Cl.[5] ..... G03G 15/02

[52] U.S. Cl. ..... 355/219

[58] Field of Search ..... 355/219, 221; 250/324, 250/325, 326; 361/230, 235; 346/153.1

[56] References Cited

U.S. PATENT DOCUMENTS

| | | | |
|---|---|---|---|
| 3,015,340 | 1/1962 | Montz et al. | 137/124 |
| 3,599,070 | 8/1971 | Davis et al. | 320/5 |
| 3,604,925 | 9/1971 | Snelling | 355/221 X |
| 3,698,926 | 10/1972 | Furuichi | 117/17.5 |
| 3,736,103 | 5/1973 | Stibbe | 23/277 |
| 3,739,491 | 6/1973 | Creapo et al. | 34/156 |
| 3,776,440 | 12/1973 | Frost et al. | 226/97 |
| 3,788,739 | 1/1974 | Coriale | 315/219 X |
| 3,873,013 | 3/1975 | Stibbe | 226/97 |
| 3,900,735 | 8/1975 | Jahn | 250/324 |
| 3,907,423 | 9/1975 | Hayashi et al. | 355/10 |
| 3,961,193 | 6/1976 | Hudson | 250/324 |
| 3,964,656 | 6/1976 | Hella | 226/97 |
| 4,019,055 | 4/1977 | Derleth | 250/324 |
| 4,021,586 | 5/1977 | Matkan | 427/17 |
| 4,052,959 | 10/1977 | Hayashi et al. | 118/644 |
| 4,116,620 | 9/1978 | Stibbe | 432/59 |
| 4,177,730 | 12/1979 | Schriber et al. | 101/248 |
| 4,182,472 | 1/1980 | Peekna | 226/97 |
| 4,197,971 | 4/1980 | Stibbe | 226/97 |
| 4,197,972 | 4/1980 | Daane | 226/97 |
| 4,197,973 | 4/1980 | Daane | 226/97 |
| 4,201,323 | 5/1980 | Stibbe et al. | 226/97 |
| 4,220,699 | 9/1980 | Ishida et al. | 430/126 |
| 4,265,384 | 5/1981 | Daane | 226/97 |
| 4,282,998 | 8/1981 | Peekna | 226/97 |
| 4,286,039 | 8/1981 | Landa et al. | 430/119 |
| 4,288,015 | 9/1981 | Curtin | 226/97 |
| 4,295,383 | 10/1981 | Frost | 474/83 |
| 4,310,238 | 1/1982 | Mochizuki et al. | 355/14 |
| 4,325,627 | 4/1982 | Suidler et al. | 355/10 |
| 4,343,769 | 8/1982 | Henkelmann | 422/109 |
| 4,369,584 | 1/1983 | Daane | 34/12 |
| 4,399,203 | 8/1983 | Bennett | 429/191 |
| 4,425,719 | 1/1984 | Klein et al. | 34/156 |
| 4,455,562 | 6/1984 | Dolan et al. | 346/154 |
| 4,462,169 | 7/1984 | Daane | 34/62 |
| 4,469,428 | 9/1984 | Yoshioka et al. | 355/221 |
| 4,474,496 | 10/1984 | Rocheleau | 432/59 |
| 4,480,859 | 11/1984 | Rueckl et al. | 285/163 |
| 4,482,624 | 11/1984 | Arney et al. | 430/138 |
| 4,515,292 | 5/1985 | Koos, Jr. | 222/52 |
| 4,563,086 | 1/1986 | Knapp et al. | 355/14 |
| 4,564,282 | 1/1986 | Shenoy | 361/235 X |
| 4,601,259 | 7/1986 | Yamashita | 118/658 |
| 4,631,244 | 12/1986 | Mitchell | 430/137 |
| 4,702,985 | 10/1987 | Larson | 430/115 |
| 4,734,737 | 3/1988 | Koichi | 355/14 |
| 4,760,423 | 7/1988 | Holtje et al. | 355/3 |
| 4,827,315 | 5/1989 | Wolfberg et al. | 346/160 |
| 4,828,956 | 5/1989 | Creatura et al. | 430/137 |
| 4,829,336 | 5/1989 | Champion et al. | 355/246 |
| 4,848,633 | 7/1989 | Hagen et al. | 226/97 |
| 4,860,924 | 8/1989 | Simms et al. | 222/56 |

*Primary Examiner*—A. T. Grimley
*Assistant Examiner*—Sandra L. Hoffman
*Attorney, Agent, or Firm*—Biebel & French

[57] ABSTRACT

In a high speed electrophotographic printing apparatus and method wherein a charge of desired polarity and potential is applied uniformly to a photoconductive surface of a rapidly rotating drum, an improvement is provided which comprises an electrometer located adjacent the drum surface for sensing and measuring the charge imparted to the surface. The electrometer is operatively connected through a programmable logic controller to a variable power output that drives the corona array to impart the charge to the drum surface. Irregularities in charge potential imparted to the surface are thereby measured by the electrometer with appropriate adjustment being made in the charge applied to the drum by the corona array.

23 Claims, 4 Drawing Sheets

CORONA CHARGE SYSTEM AND APPARATUS FOR ELECTROPHOTOGRAPHIC PRINTING PRESS

FIELD OF THE INVENTION

The present invention pertains to a high speed electrophotographic printing press and specifically to methods and apparatus for charging the surface of the photoconductive printing cylinder and for compensating for irregularities in the charge imparted thereto.

BACKGROUND OF THE INVENTION

Electrophotographic printing is well known and has been widely refined. For example, today, almost every office and indeed some homes have electrophotographic copiers. The industry has grown to the point where it is now a highly competitive multi-billion dollar industry. In most instances, these home and office copiers are capable of providing only about a few copies per minute.

In electrophotography, images are photoelectrically formed on a photoconductive layer mounted on a conductive base. Liquid or dry developer or toner mixtures may be used to develop the requisite image.

Liquid toner dispersions for use in the process are formed by dispersing dyes or pigments and natural or synthetic resin materials in a highly insulating, low dielectric constant carrier liquid. Charge control agents are added to the liquid toner dispersions to aid in charging the pigment and dye particles to the requisite polarity for proper image formation on the desired substrate.

The photoconductive layer is sensitized by electrical charging whereby electrical charges are uniformly distributed over the surface. The photoconductive layer is then exposed by projecting or alternatively by writing an image over the surface with a laser, L.E.D., or the like. The electrical charges on the photoconductive layer are conducted away from the areas exposed to light with an electrostatic charge remaining in the image area. The charged pigment and/or dye particles from the liquid toner dispersion contact and adhere to the image areas of the photoconductive layer. The image is then transferred to the desired substrate, such as a travelling web of paper or the like.

In contrast to office and home copiers, high speed electrophotographic printing presses are being developed wherein successive images are rapidly formed on the photoconductive medium for rapid transfer to carrier sheets or the like travelling at speeds of greater than 100 ft./min. and even at speeds of from 300–500 ft./min. As can be readily understood, in such high speed methods and devices, to provide a commercially viable product, it is desirable to accurately charge the photoconductive surface adequately so that image formation will be of a high quality, uniform nature. As such, it is desirable to provide a control system to ensure that the desired, predetermined charge is imparted to the rapidly rotating photoconductor despite irregularities that may occur, for instance, due to irregular "out of round" cylinders, photoconductor deterioration, or other causes.

Such control systems are not, per se, new. However, the known prior art systems were used in conjunction with office copiers that could not meet the high speed requirements of the high speed electrophotographic printing press herein contemplated and they did not provide feedback control to a plurality of charge coronas.

It is also desirable to provide a support mechanism for the electrical charging means that ensures proper spacing of the corona discharge wires above the photoconductive cylinder and is easily detached from the printing press for repair and maintenance.

SUMMARY OF THE INVENTION

The above and other objects of the invention are met by the use of a feedback process and system that measure the potential imparted to the photoconductive surface and then adjust the potential supplied to the charging corona array to compensate for irregularities that may exist from a predetermined norm. An electrometer measures the actual potential imparted to the photoconductive surface. The electrometer relays this information to a programmable logic controller (PLC) that compares the actual potential imparted to the photoconductive surface to that desired. As a result, the PLC then signals a variable potential power source connected to the corona charging array to make appropriate adjustment in the potential imparted thereto so as to result in the desired charge being imparted to the photoconductive surface by the corona charging array.

The desired electrical charge is imparted to the photoconductive surface by a plurality of corona discharge wires that extend closely above the surface and are transversely oriented with respect to the movement direction of the surface.

The wires are carried by and housed within a shield member that is provided with elongated channels, with each wire disposed in a channel. The shield member is removably mounted in brackets that extend transversely across and above the photoconductive surface. In a preferred embodiment, the shield is provided with flanges that slidably fit and are received within grooves formed in the bracket. Accordingly, the entire shield assembly with its associated corona charge wires may be readily detached from the printing press for purposes of cleaning, repair, etc.

The invention will now be further described in conjunction with the appended drawings and the following detailed description.

Figure 1:
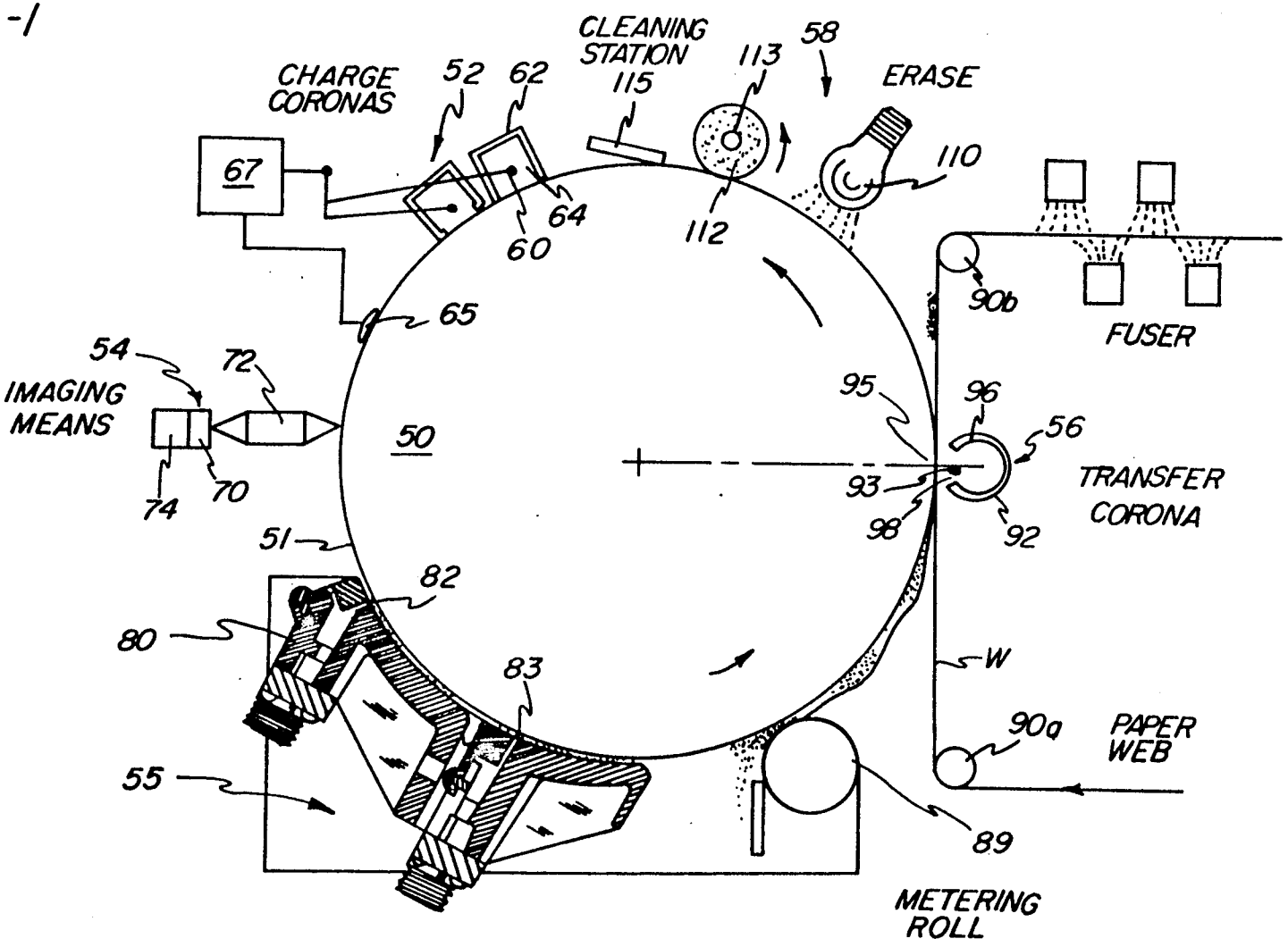
FIG. 1 is a schematic diagram showing the photoconductive printing cylinder, associated operating stations and print transfer mechanism in accordance with the invention.

Turning to FIG. 1, this view shows the overall organization of a typical photoconductive cylinder and associated mechanisms for formation of the latent electrostatic image, and subsequent image formation on the cylinder surface. A rotatable photoconductive drum 50, typically $As_2Se_3$ or SeTe, rotates in a counterclockwise direction as indicated by the arrow shown on cylinder 50 in FIG. 1. Special systems are arranged sequentially around drum 50 as shown in FIG. 1, to accomplish the desired formation and transfer of images onto web w. These systems include a high intensity charging apparatus 52, exposing-discharging (or imaging) apparatus 54, developing apparatus 55, transfer apparatus 56 and cleaning apparatus 58. These assure that the drum surface is charged, exposed, discharged and cleared of residual toner, while the developed images are continually transferred to the web material w.

Charging apparatus 52 comprises a plurality of corona discharge devices comprising corona discharge wires 60 disposed within appropriately shaped shielded members 62 with each wire 60 and associated shield member 6 forming a separate focusing chamber 64. Although only two such corona discharge devices are shown in FIG. 1, in practice, five of same are employed to help ensure that the proper potential is imparted to the photoconductive surface. It is to be appreciated that due to the rapid peripheral speed of drum 50, it is necessary to provide such a large array of corona charging means in light of the necessity of imparting a relatively high charge potential of the order specified to the photoconductive surface within the very short time provided for this task.

The charge imparted by the coronas to the photoconductive cylinder is on the order of at least +1000 volts d.c., preferably between +1000 and +1450 volts. At present, a charge of +1100v is clearly preferred. In order to charge the photoconductive surface to such high voltages, it is necessary to charge each of the corona charge wires 60 at +5600 to about +6500v d.c. The corona assemblies extend across the drum surface 51 and along an arc closely parallel to surface 51. In a successful embodiment using a drum having a 33-inch circumference (thus 10.504-inch diameter) the arcuate length of the charging unit is about 4.5 inches or somewhat greater than ⅛th of the drum circumference.

Proceeding counterclockwise around the drum (as viewed in FIG. 1), there is a charge potential sensor 65 (an electrometer) which senses the voltage at the surface 55 and provides a continuous feedback signal to the charging power supply 67 to thereby adjust the charge level of the photoconductor surface 51 regardless of variations due, for example, to irregularities in the power supply or changes in the peripheral velocity of drum 50, drum shape irregularities or photoconductor wear and deterioration.

Figure 2:
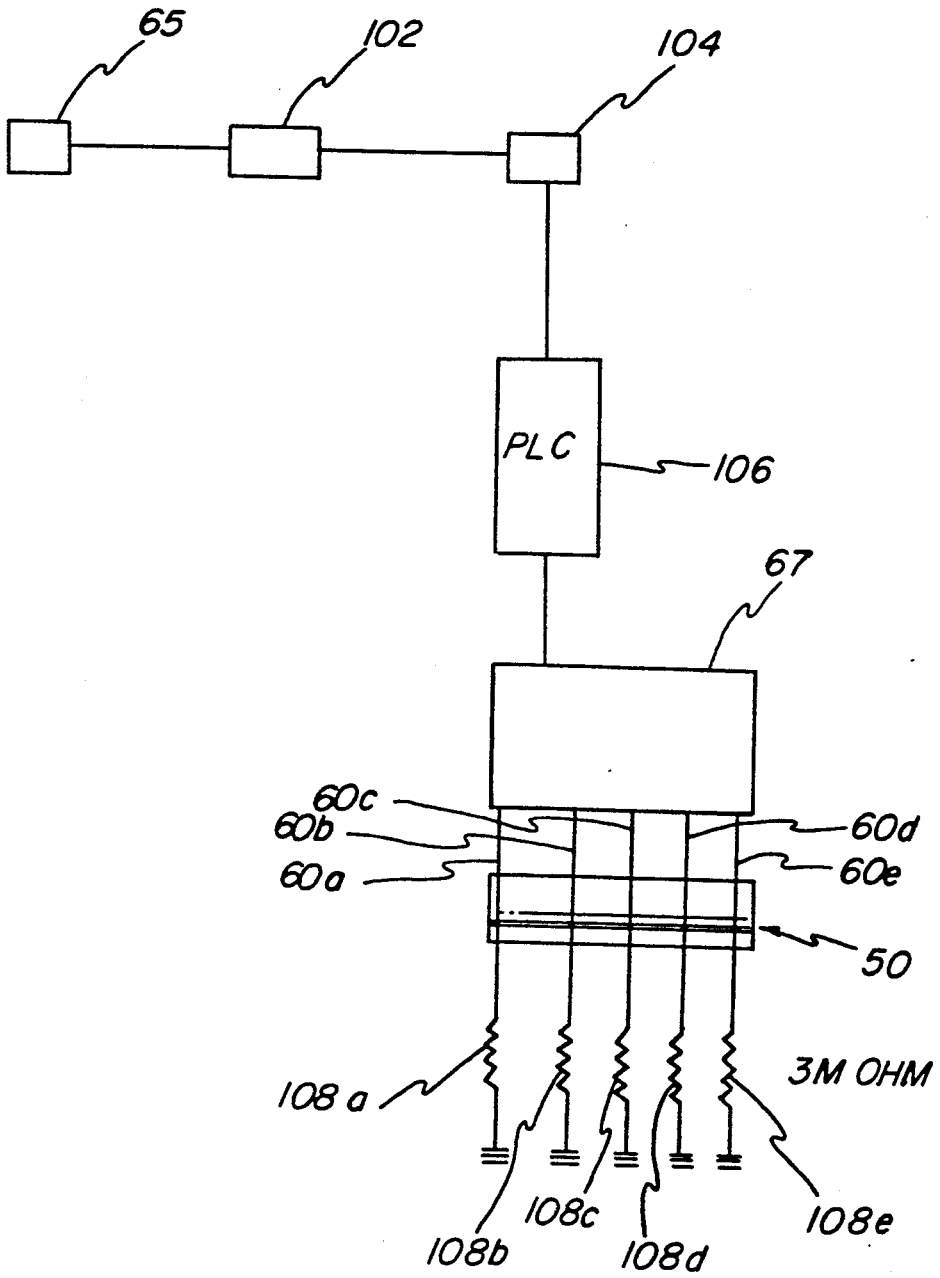
FIG. 2 is a block diagram showing, schematically, the closed loop charging control mechanism of the invention.

Turning to FIG. 2, the information sensed by sensor 65 is forwarded to a high speed amplifier 102 which receives the signal from sensor 65 and, as an output, forwards a voltage signal from 0–5v to resistive capacitance network 104 which averages fluctuations in the signal over a time period of about 2.5 seconds. Network 104 is of conventional nature and may be referred to as a time constant RC network. The output from the RC network is a smooth signal that is forwarded to programmable logic controller 106 that is, for example, Texas Instruments Model 565.

The signal received by the PLC 106 is compared to an expected normal signal that corresponds to, for example, +1100v charge on the photoconductor surface. When variations of either plus or minus 20% of this value are sensed by the PLC, a signal is sent to the variable voltage power supply unit 67 to either increase or decrease potential output supplied to the corona discharge wires 60*a*, 60*b*, 60*c*, 60*d*, 60*e*, in parallel, so that the desired voltage (e.g., +1100v) is imparted thereby to the photoconductor surface.

Corona discharge wires 60*a–e* are each connected to resistors 108*a–e* prior to grounding of the wires. The resistors have resistances, each of about 3 megohms. The resistors are necessary in order to inhibit arcing that may otherwise occur due to the large potentials (i.e., +5600v to +6800v) impressed upon the wires in order to impart the correct voltages to the photoconductor.

Figure 3:
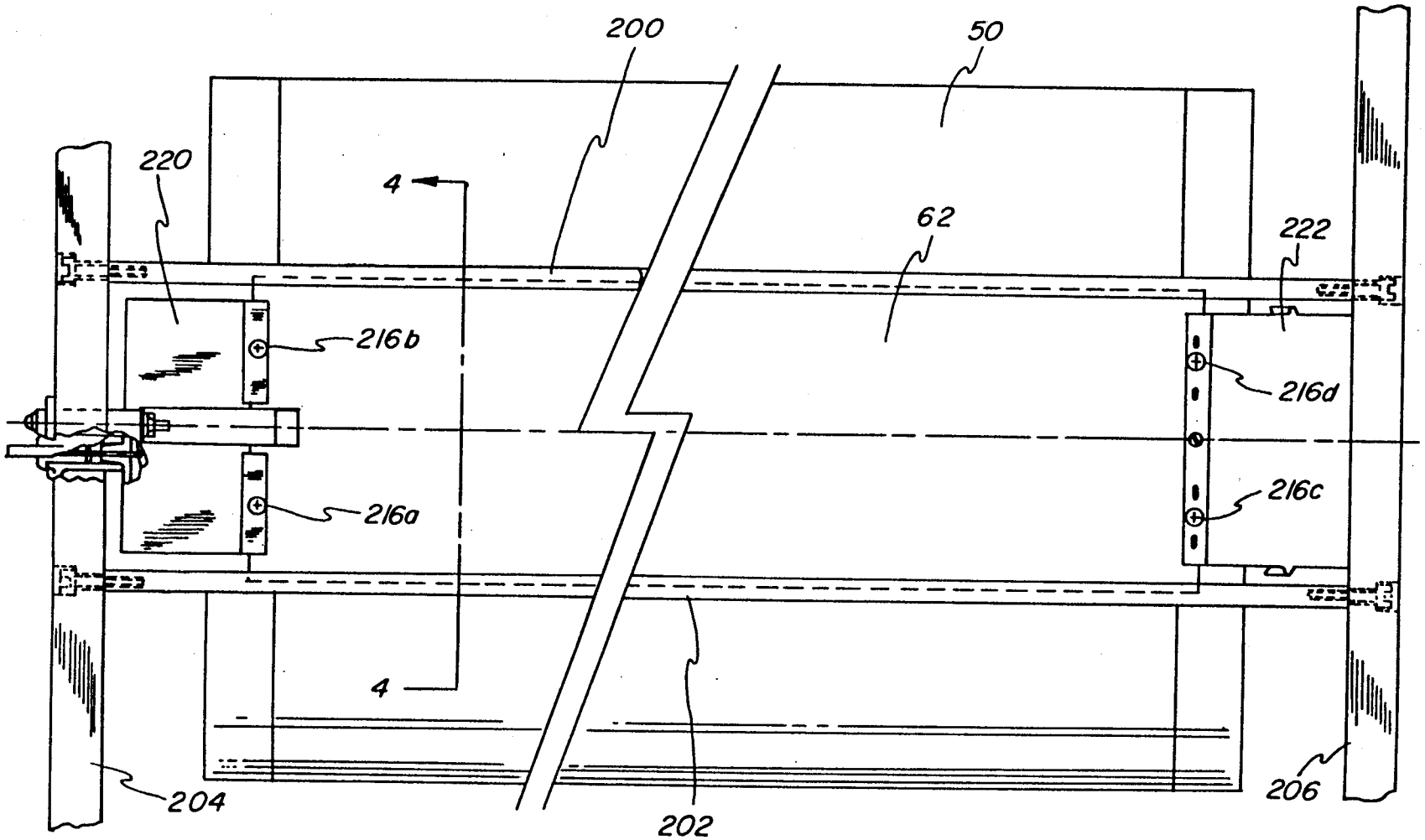
FIG. 3 is a plan view of the charging corona array and associated support bracket.
Figure 4:
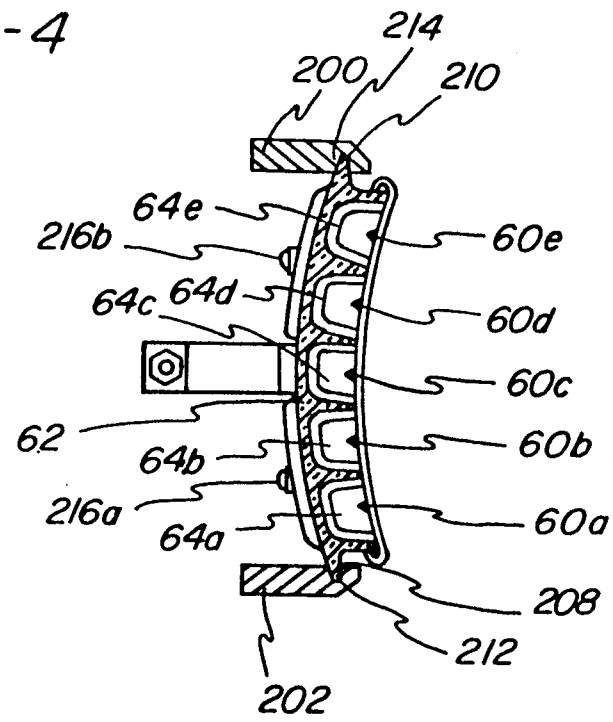
FIG. 4 is a sectional view taken along the lines and arrows 4—4 shown in FIG. 3.

Turning now to FIGS. 3 and 4, there is shown the corona charging array and associated support mechanism. Brackets 200, 202 are secured in frame members 204, 206 via screws or the like so that the brackets are slightly spaced from and extend transversely over the surface of drum 50. That is, the brackets extend in the axial direction of drum 50. The shield member 62 is generally arcuately shaped and is inserted into brackets 200, 202 via flanges 208, 210 that slide into corresponding recesses 212, 214 formed in the brackets.

The shield member 62 is preferably formed of lightweight extruded aluminum with the brackets being composed of, for example, Delrin® plastic. As shown, five corona discharge wires 60*a–e* are provided with each wire being disposed in and extending along a substantially "C" cross-sectioned channel 64*a–e* formed in the shield 62. The channels 64*a–e* are evenly spaced from each other and provide a separate housing for each wire 60*a–e* to ensure that the ions created by discharge wires 60*a–e* are properly deflected and directed onto the surface of drum 50 to provide for proper charging thereof.

End-cap members 220, 222 are provided at endwise portions of the shield 62 and are secured thereto by the provision of screws 216*a–d*. The end-cap members are preferably made of plastic and serve to house the electrical leads thus securing same, fuses, and resistors As is apparent from review of FIGS. 3 and 4, the provision of shield 62, the five evenly spaced channels thereof 64*a–e*, and the slidable mounting of the shield to the brackets 200, 202 provides for proper spacing of the wires 60*a–e* and easy service and repair of the entire charging unit.

Once again considering FIG. 1, digital imaging device 54, in the form of relatively high intensity L.E.D. double row array 70 is mounted to extend transversely of the rotating drum surface 51. Each L.E.D. is individually driven from a corresponding driver amplified circuit, details of which need not be described herein. Light emitted from the L.E.D.s is in the range of 655–685 nm through a Selfoc TM lens 72 (Selfoc is a trademark of Nippon Sheet Glass) onto the drum surface 51 in a dot size of 0.0033 inch diameter. In one successful embodiment, there are a total of 6144 L.E.D.s in the array, divided between two rows which are spaced apart in a direction along the circumference of the surface by 0.010 inch and all fixed to a liquid cooled base block 74. The space between adjacent L.E.D.s in the same row is 0.0033 inch horizontally or transverse to the drum surface and the L.E.D. arrays in the two rows are offset horizontally by the same dimension, thus the L.E.D.s can cooperate to discharge a continuous series of dots across drum surface 51 at a resolution of 300 dots/inch.

Light from the L.E.D.s operates to discharge the background or non-image areas of the passing drum surface to a substantially lower potential, for example, in the order of +100 to +300 volts d.c. by exposing individual dot areas to radiation at a predetermined frequency, as mentioned whereby the remaining or image areas comprise a latent electrostatic image of the printed portions of the form.

Although the use of an L.E.D. arrangement has been depicted herein as providing for the requisite image, other conventional means for forming the requisite image may also be utilized. For instance, laser printing and conventional exposure methods through transparencies and the like may also be utilized, although they are not preferred.

The latent electrostatic image then is carried, as the drum rotates, past developing station 55 where it is subjected to the action of a special high speed liquid toner developer of the type comprising a dielectric carrier liquid material, such as the Isopar series of hydrocarbon fractions, resinous binder particles, and color-imparting dye and/or pigment particles. As is known in the art, the desired charge may be chemically supplied to the resin-pigment/dye particles by utilization of well-known charge control agents such as lecithin and alkylated vinylpyrrolidone materials. In the embodiment shown, drum 50 comprises an $As_2Se_3$ photoconductive layer to which charge coronas 52 impart a positive charge. The toner particles are accordingly provided with a negative charge in the range of about 60 to 75 picamhos/cm.

The developing station 55 comprises a shoe member 80, which also functions as a developer electrode (which is electrically insulated from drum 50 and extends transversely across drum surface 51). The face of shoe member 80 is curved to conform to a section of drum surface 51 and, in a successful embodiment, has a length, along the arcuate face, of about 7 inches, slightly less than ¼ of the circumference of drum surface 51, and which is closely fitted to the moving drum surface, for example, at a spacing of about 50 microns (0.020 inch). Shoe 80 is divided into first and second cavities 82, 83 through each of which is circulated liquid toner dispersion from a liquid toner dispersion supply and replenishment system.

The developer shoe 80 functions as an electrode which is maintained at a potential on the order of about 200 to 600 volts d.c varied according to the drum velocity. Thus, the negatively charged toner particles are introduced into the shoe cavities and dispersed among electrical fields between: (1) the image areas and the developer electrode on the one hand and between (2) the background and the developer electrode on the other hand. Typically, the electrical fields are the result of difference in potential: (a) between the images areas (+1000 to 1450 volts) and the non-image areas (+100 to +300 volts) which causes the negatively charged toner particles to deposit on the image areas, and (b) the field existing between the background areas (+100 to +300 volts) and the developer electrode (+200 to +600 volts) which later field causes the toner particles to migrate away from the background areas to the developer shoe. The result is a highly distinctive contrast between image and background areas, with good color coverage being provided in the solid image areas. The tendency of toner particles to build up on the developer shoe or electrode is overcome by the circulation of the liquid toner therethrough at rates in the order of about 7.57 to 37.85 liters/min. (2 to 10 gallon/min.) back to the toner refreshing system.

As the drum surface passes from the developer shoe, a reverse rotating metering roll, spaced parallel to the drum surface by about 50–90 microns, acts to shear away any loosely attracted toner in the image areas, and also to reduce the amount of volatile carrier liquid carried by the drum and any loose toner particles which might have migrated into the background areas. The metering role has applied to it a bias potential on the order of about +200 to +600 volts d.c. varied according to web velocity.

Proceeding further in the counterclockwise direction with respect to FIG. 1, there is shown transfer apparatus 56 as including a pair of idler rollers 90 which guide web W onto the "3o'clock" location of drum 50, and behind the web path at this location is a transfer coratron 92. The web is driven at a speed equal to the velocity of drum surface 51, to minimize smudging or disturbance of the developed image on the surface 51. The positioning of rollers 90 is such that the width (top-bottom) of the transverse band 95 of web-drum surface contact is about from 0.05–0.2 inch, preferably 0.6 inch, centered on a radius of the drum which intersects the coratron wire 93, as shown by the dot-dash line in FIG. 2.

The shape of the transfer coratron shield 96, and the location of the axis of the tungsten wire 93 in shield 96, is such as to focus the ion "spray" 98 from the coratron onto the web-drum contact band on the reverse side of web W. The transfer coratron 92 has applied to it a voltage in the range of +6600 to +8000v d.c., and the distance between the coratron wire 93 and the surface of web W is in the order of 0.250 to 0.312 inch. This results in a transfer efficiency of at least 95%. Both toner particles and liquid carrier transfer to the web, including carrier liquid on the drum surface 51 in the background areas.

Accordingly, by the imposition of an electrical voltage of about +6600 to +8000v d.c. by the transfer coratron 92 onto the backside of travelling web W and since the charge on the image on cylinder 50 is about +1000v, a powerful electrical field (e.g., at least about 5,000v) from the web W to the cylinder is created. The negatively charged solids toner particles are thereby strongly directed to migrate counter to this field and adhere to the web surface in the web-cylinder interface area. Preliminary results have indicated that the efficiency of the transfer system is about at least 95%. That is, 95% or greater of the solids toner particles travelling on cylinder 50 are transferred to the web. Carrier liquid is also transferred to the web at the web-cylinder interface primarily through surface contact and capillary action.

The fact that such rapid and efficient image transfer occurs is important due to the high accuracy requirements of the overall printing apparatus and system. As above noted, it is essential that the web W travel at a speed equal to the peripheral (surface) speed of cylinder 50 at the web-cylinder interface so as to reduce image smearing and smudge formation. This dictates that web W be driven synchronously with the peripheral speed of cylinder 50. This, in accordance with the high speed requirements of the press, requires web speeds of 100 ft./min. up to about 600 ft./min.

As is shown in FIG. 1, the cross-section shape of coratron shield 96 is substantially a reversed "C" section. This particular configuration, as well as others, focuses a narrow band of ions at the web cylinder interface. Although the use of idler rollers 90*a*, 90*b* has been depicted, and indeed is preferred, as functioning to present a portion of web W adjacent to and in contact with a portion of cylinder 50 at essentially the three o'clock position, other equivalent conveyor means can be used. Also, as shown, the idler rollers 90*a*, and 90*b* are both located intermediate drum 50 and transfer corona 92. Other arrangements can be successfully employed so long as the web W in the area of surface contact with drum 50 is synchronously driven with respect to the peripheral speed of drum 50.

Although this invention has been described with respect to certain preferred embodiments, it will be appreciated that a wide variety of equivalents may be substituted for those specific elements shown and described herein, all without departing from the spirit and scope of the invention as defined in the appended claims.

I claim:

1. High speed electrophotographic printing process of the type including a rotatable cylinder having a photoconductive surface rotating at a peripheral speed of at least about 100 ft./min., wherein a latent electrostatic image is formed on said surface by imparting a first charge of a desired given polarity and desired potential over said surface and subsequently exposing non-image areas of said surface to dissipate said first charge in said non-image areas to form a second charge in said non-image areas of lesser potential than and common polarity with said first charge, the improvement comprising:

sensing and comparing the potential imparted by said first charge to a predetermined value, and, in response to said sensing and comparing, varying the output of a variable voltage source to adjust the potential imparted by said first charge to correspond to said desired potential.

2. Process as recited in claim 1 wherein said sensing comprises providing an electrometer to scan the voltage imparted to said cylinder.

3. Process as recited in claim 2 wherein said first charge is imparted to said photoconductive surface by an array of corona discharge means positioned transversely across said cylinder.

4. Process as recited in claim 3 comprising charging said corona discharge means with a potential of about +5600 to +6800v and imparting a first charge to said cylinder surface of about +1000 to +1450v therewith.

5. Process as recited in claim 4 wherein said sensing further comprises sending a signal from said electrometer to a programmable logic controller where said signal is compared to said predetermined value.

6. Process as recited in claim 5 wherein said predetermined value corresponds to about +1100v for said first charge.

7. Process as recited in claim 6 further comprising, subsequent to said comparing, sending a signal from said programmable logic controller to said variable voltage source wherein said variable voltage source is connected to said corona discharge means.

8. High speed electrophotoconductive printing apparatus of the type including a rotatable cylinder having a photoconductive surface rotating at a peripheral speed of at least about 100 ft./min. and wherein means are provided for forming, on said surface, a latent electrostatic image by imparting a first charge of a given polarity and potential over said surface and for subsequently exposing non-image areas of said cylinder surface to dissipate said first charge in said non-image areas of said surface to form, in said non-image areas, a second charge of lesser potential than and common polarity with said first charge, the improvement comprising:

(a) sensor means located proximate said cylinder for sensing the potential imparted by said first charge; and (b) adjustment means comprising an adjustable power source, responsive to said sensor means and connected to said means for imparting said first charge for adjusting the potential actually imparted by said first charge to correspond to said desired potential.

9. Apparatus as recited in claim 8 wherein said sensor means comprises an electrometer.

10. Apparatus as recited in claim 9 further comprising an array of corona discharge means extending transversely across said rotatable cylinder and closely spaced therefrom for imparting said first charge.

11. Apparatus as recited in claim 10 wherein said adjustable power source is connected to said array of corona discharge means.

12. Apparatus as recited in claim 11 wherein each member of said array is connected to a resistor means.

13. Apparatus as recited in claim 12 wherein each said resistor means has a resistance of about three megohms.

14. Apparatus as recited in claim 10 wherein said electrometer is electrically connected to a high speed amplifier.

15. Apparatus as recited in claim 14 wherein said high speed amplifier is electrically connected to a resistive capacitance network (RCN).

16. Apparatus as recited in claim 15 wherein said RCN is connected to a programmable logic controller which is connected to said adjustable power source.

17. High speed electrophotographic printing process of the type including a rotatable cylinder having a photoconductive surface rotating at a peripheral speed of at least about 100 ft./min., wherein a latent electrostatic image is formed on said photoconductive surface by an array of corona discharge means positioned transversely across said cylinder, said corona discharge means being charged to a potential of about +5600 to +6800 volts to impart a first charge to said cylinder surface of about +100 to +1450 volts, subsequently exposing non-image areas of said surface to dissipate said first charge in said non-image areas to form a second charge in said non-image areas of lesser potential than and common polarity with said first charge, sensing the potential imparted by said corona discharge means by means of an electrometer, sending a signal from said electrometer to a programmable logic controller and comparing said signal to a predetermined value corresponding to about +1100 volts for said first charge, and subsequent to said comparing, sending a signal from said programmable logic controller to a variable voltage source connected to said corona discharge means to adjust the potential imparted by said first charge to correspond to said desired potential.

18. High speed electrophotoconductive printing apparatus of the type including a rotatable cylinder having a photoconductive surface rotating at a peripheral speed of at least about 100 ft./min. and wherein an array of corona discharge means are provided extending transversely across said rotatable cylinder and closely spaced therefrom for forming, on aid surface, a latent electrostatic image by imparting a first charge of a given polarity and potential over said surface and for subsequently exposing non-image areas of said cylinder surface to dissipate said first charge in said non-image areas of said surface to form, in said non-image areas, a second charge of lesser potential than and common polarity with said first charge, the improvement comprising:

(a) sensor means comprising an electrometer located approximate said cylinder for sensing the potential imparted by said first charge; and (b) adjustment means, responsive to said sensor means, comprising an adjustable power source connected to said array of corona discharge means for adjusting the potential actually imparted by said first charge to correspond to said desired potential.

19. Apparatus as recited in claim 18 wherein each member of said array is connected to a resistor means.

20. Apparatus as recited in claim 19 wherein each resistor means has a resistance of about 3 megohms.

21. Apparatus as recited in claim 18 wherein said electrometer is electrically connected to a high speed amplifier.

22. Apparatus as recited in claim 21 wherein said high speed amplifier is electrically connected to a resistive capacitance network (RCN).

23. Apparatus as recited in claim 22 wherein said RCN is connected to a programmable logic controller which is connected to said adjustable power source.

* * * * *

UNITED STATES PATENT AND TRADEMARK OFFICE

CERTIFICATE OF CORRECTION

PATENT NO. : 5,017,964

DATED : May 21, 1991

INVENTOR(S) : Paul V. Sadwick

It is certified that error appears in the above-identified patent and that said Letters Patent is hereby corrected as shown below:

Column 8, Line 36, Claim 17, delete "+100" and insert -- +1000 --.

Column 8, Line 57, Claim 18, delete "aid" and insert -- said --.

Signed and Sealed this

Twenty-seventh Day of October, 1992

*Attest:*

DOUGLAS B. COMER

*Attesting Officer*

*Acting Commissioner of Patents and Trademarks*